US010045611B1

(12) United States Patent
Siebert et al.

(10) Patent No.: US 10,045,611 B1
(45) Date of Patent: Aug. 14, 2018

(54) TABLE APPARATUSES

(71) Applicant: Brunswick Corporation, Lake Forest, IL (US)

(72) Inventors: Paul Brian Siebert, Chicago, IL (US); Jess Allen Sorel, Oakland, CA (US)

(73) Assignee: Brunswick Corporation, Mettawa, IL (US)

( * ) Notice: Subject to any disclaimer, the term of this patent is extended or adjusted under 35 U.S.C. 154(b) by 60 days.

(21) Appl. No.: 15/180,515

(22) Filed: Jun. 13, 2016

Related U.S. Application Data

(63) Continuation-in-part of application No. 29/533,629, filed on Jul. 20, 2015, now Pat. No. Des. 778,652.

(60) Provisional application No. 62/211,216, filed on Aug. 28, 2015.

(51) Int. Cl.

| | |
|---|---|
| ***A47B 57/00*** | (2006.01) |
| ***A47B 13/08*** | (2006.01) |
| ***A47B 87/00*** | (2006.01) |
| ***A47B 13/12*** | (2006.01) |

(52) U.S. Cl.
CPC ..... *A47B 13/081* (2013.01); *A47B 13/088* (2013.01); *A47B 13/12* (2013.01); *A47B 87/002* (2013.01)

(58) Field of Classification Search
CPC ..... A47B 11/00; A47B 17/06; A47B 17/065
USPC ..... 108/23, 50.01, 64, 92–95, 103
See application file for complete search history.

(56) References Cited

U.S. PATENT DOCUMENTS

| | | | | |
|---|---|---|---|---|
| 972,356 | A * | 10/1910 | Funk | A47B 11/00 108/159 |
| 5,842,425 | A * | 12/1998 | van der Aa | A47B 17/065 108/103 |
| 5,943,966 | A | 8/1999 | Machado et al. | |
| 6,102,475 | A * | 8/2000 | Hamann | A47B 83/02 108/27 |
| 6,497,184 | B1 | 12/2002 | Whitesitt | |
| 6,662,734 | B2 | 12/2003 | Chang | |
| 6,997,114 | B2 * | 2/2006 | Chang | A47B 17/06 108/64 |
| 2015/0300627 | A1 * | 10/2015 | Wang | F21V 33/0012 108/23 |

* cited by examiner

*Primary Examiner* — Matthew W Ing
(74) *Attorney, Agent, or Firm* — Andrus Intellectual Property Law, LLP

(57) ABSTRACT

A table apparatus includes first, second, and third work surfaces. The second work surface is pivotable with respect to the first work surface at a first pivot axis, and the third work surface is pivotable with respect to the first work surface at a second pivot axis that is parallel to and spaced apart from the first pivot axis. The table apparatus can include a controller configured to control a lighting device positioned between the first work surface and the second work surface and/or third work surface.

16 Claims, 8 Drawing Sheets

TABLE APPARATUSES

CROSS REFERENCE TO RELATED APPLICATIONS

This application claims the benefit of and priority to U.S. Provisional Patent Application No. 62/211,216, filed Aug. 28, 2015, and U.S. Design Pat. Application No. 29/533,629, filed Jul. 20, 2015, which are hereby incorporated by reference in entirety.

FIELD

The present disclosure relates to table apparatuses, specifically to table apparatuses having a plurality of pivotable work surfaces.

BACKGROUND

The following U.S. Patents are hereby incorporated by reference in their entirety:

U.S. Pat. No. 5,943,966 discloses a furniture system having a countertop midsection, two tower units with gliding base, a rigid screen, and flexible partitions. Using the tower unit shaft's neck, a pivoting connection is used to provide the flexibility of arrangement.

U.S. Pat. No. 6,497,184 discloses a pivoting structure for joining and supporting two co-planar surfaces that pivot independently around a fixed point between the tables at one end on a pivot assembly. The co-planar surfaces are supported at the opposite end by a support leg that provides rotation quickly and easily by one person by means of a pivoting wheel. An array of positions can be fixed by means of a wheel brake lever.

U.S. Pat. No. 6,662,734 discloses a connection device for tables including a shaft on which a first part and a second part are respectively mounted thereon. The two parts are pivotally connected with each other and have their own connection shafts. Each of the connection shafts is connected to a table top so that the two table tops are pivotable about the shaft.

SUMMARY

This Summary is provided to introduce a selection of concepts that are further described herein below in the Detailed Description. This Summary is not intended to identify key or essential features from the claimed subject matter, nor is it intended to be used as an aid in limiting the scope of the claimed subject matter.

In certain examples, a table apparatus comprises a first work surface having a first end and a second end that is opposite the first end; a second work surface that is pivotable with respect to the first work surface at a first pivot axis; and a third work surface that is pivotable with respect to the first work surface at a second pivot axis that is parallel to and spaced apart from the first pivot axis. The first work surface and second work surface are overlapping and the first work surface and the third work surface are overlapping. In certain examples, an indicator system includes a lighting device such as a light track positioned between the first work surface and the second work surface. A controller is configured to control the lighting device to illuminate the second work surface according to a calendar or other input to the controller.

BRIEF DESCRIPTION OF THE DRAWINGS

Examples are described with reference to the following drawing FIGURES. Like reference numbers are used throughout the FIGURES to reference like features and components.

DETAILED DESCRIPTION OF THE DRAWINGS

The present disclosure includes examples of table apparatuses having pivotable work surfaces. Through research and experimentation, the present inventors have endeavored to provide table apparatuses that are reconfigurable to suit the needs of users. In certain examples, a table apparatus includes work surfaces that are pivotable with respect to each other. Pivoting of the works surfaces allows users to reconfigure or modify the shape and orientation of the table apparatus. The table apparatuses can be provided with indicator systems and related accessory devices (such as lighting devices, audio systems, and/or the like) that facilitate meeting and/or scheduling notifications to the users. For example, the table apparatus can have a light track that displays a light at a scheduled meeting end time and an audio speaker that produces an audible sound at the scheduled meeting end time.

Figure 1:
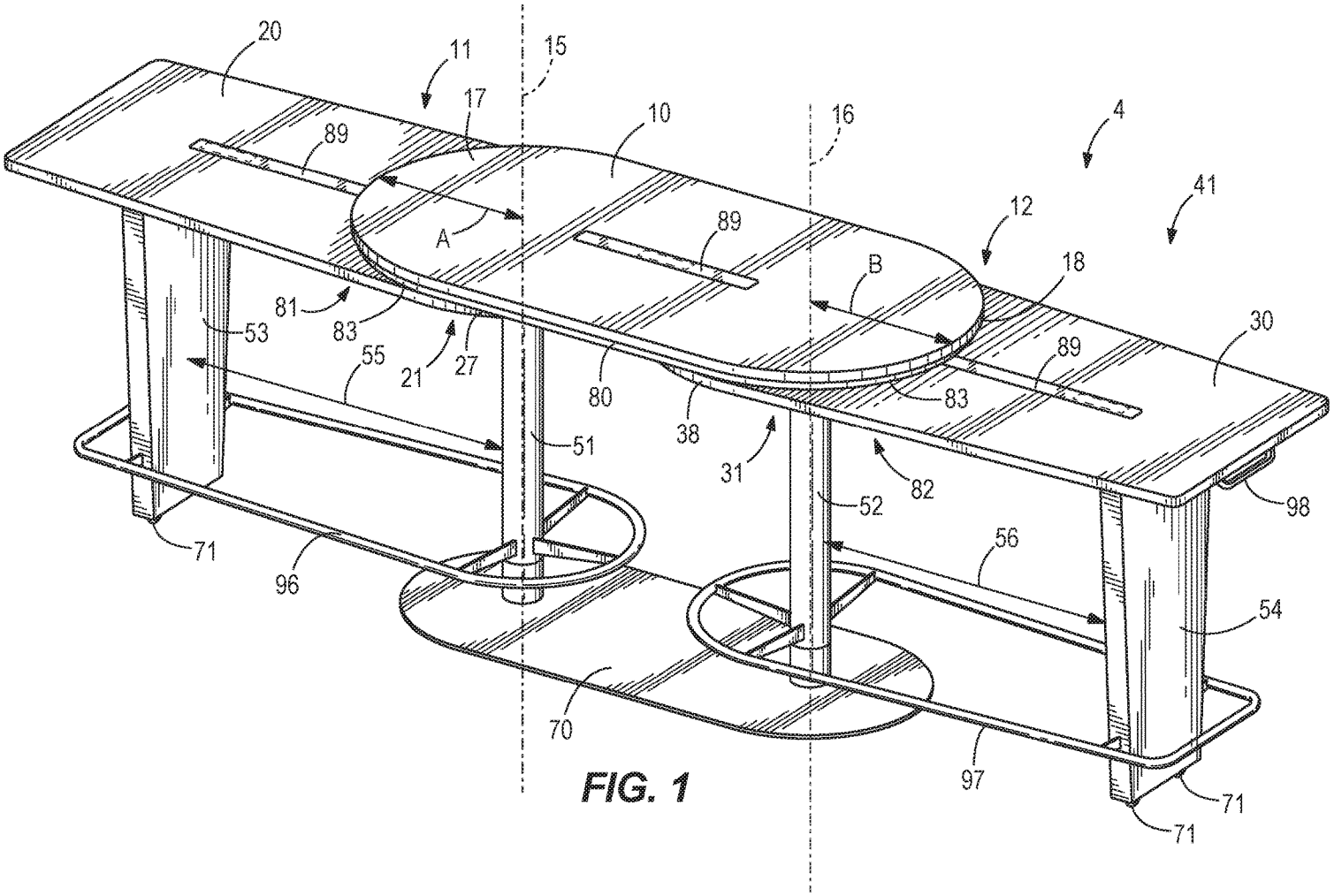
FIG. 1 is an example of a table apparatus according to the present disclosure.
Figure 2:
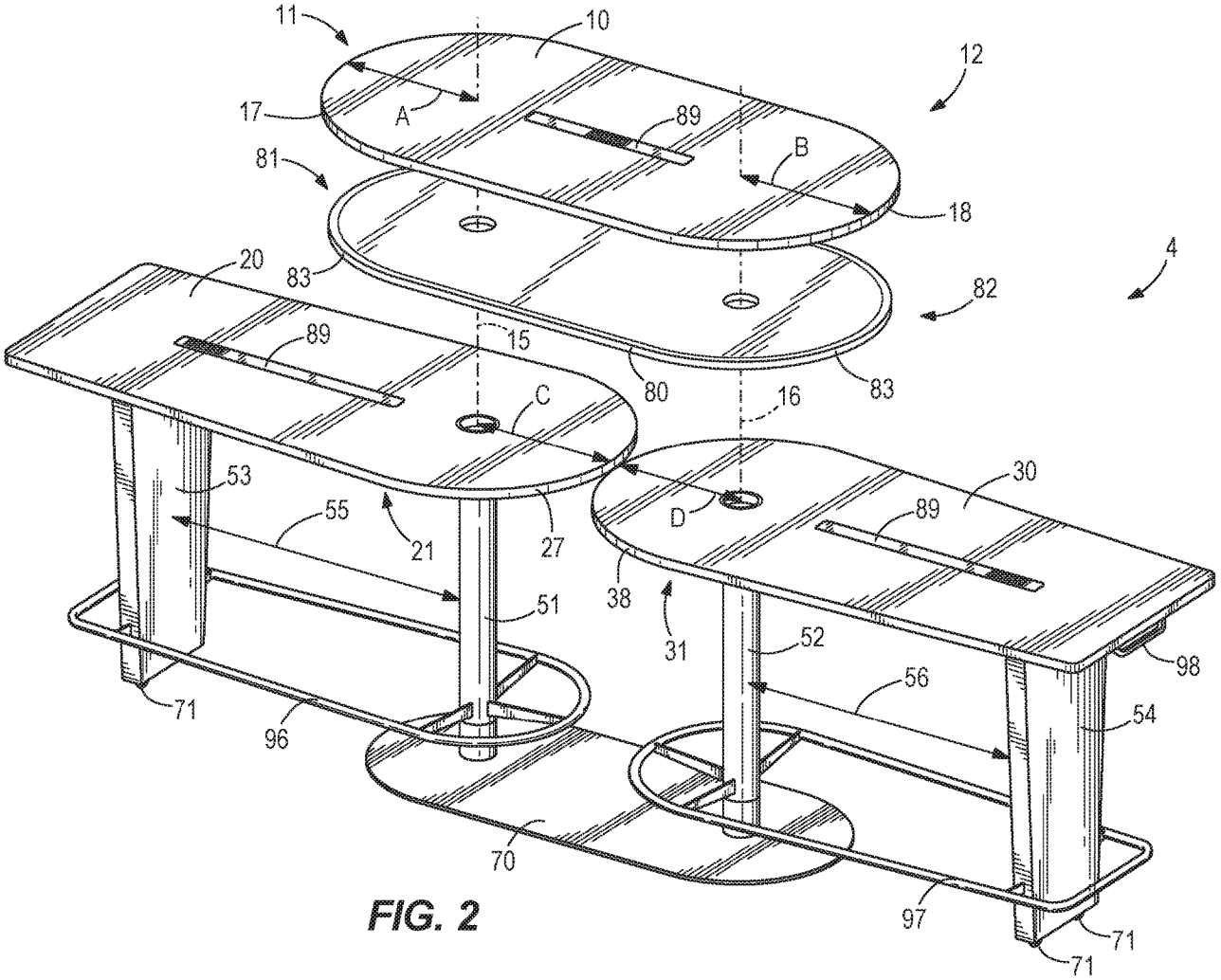
FIG. 2 is an exploded view of the table apparatus depicted in FIG. 1
Figure 3:
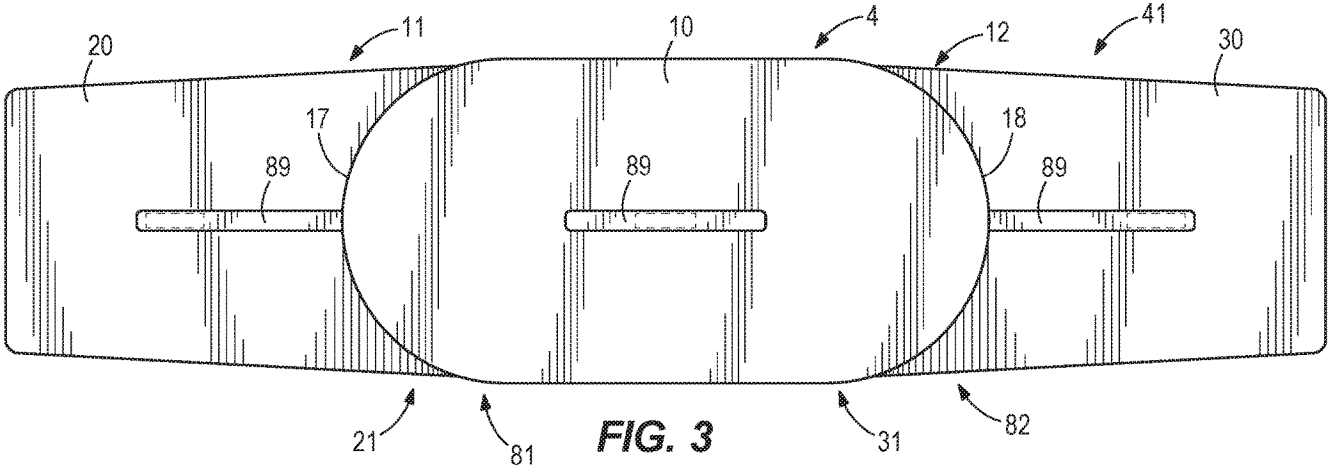
FIG. 3 is a top view of the table apparatus depicted in FIG. 1.
Figure 4:
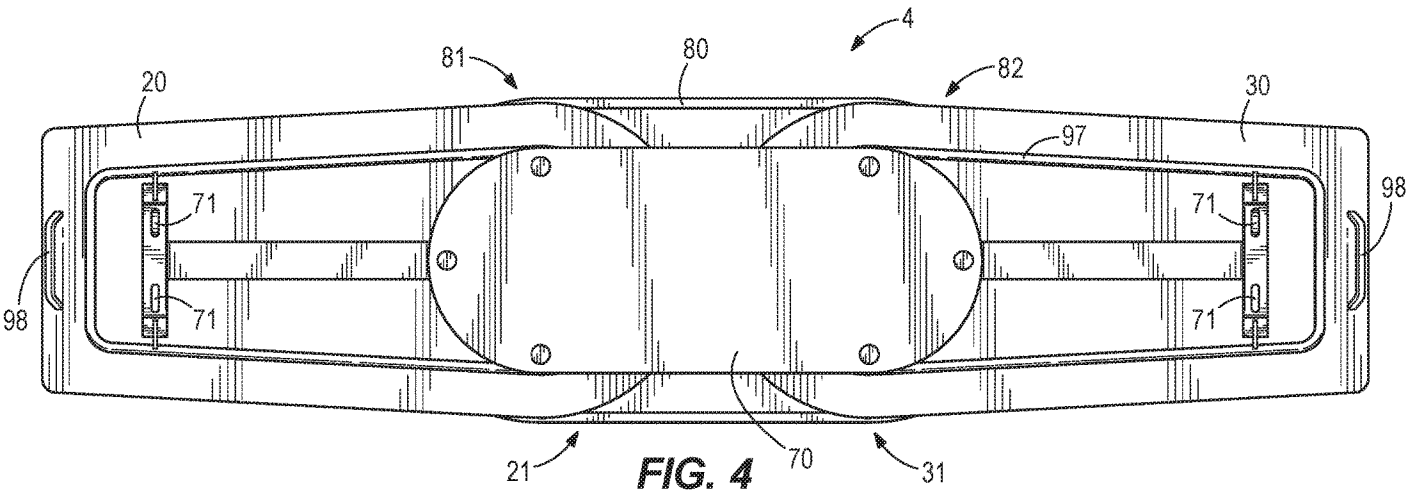
FIG. 4 is a bottom view of the table apparatus depicted in FIG. 1.
Figure 5:
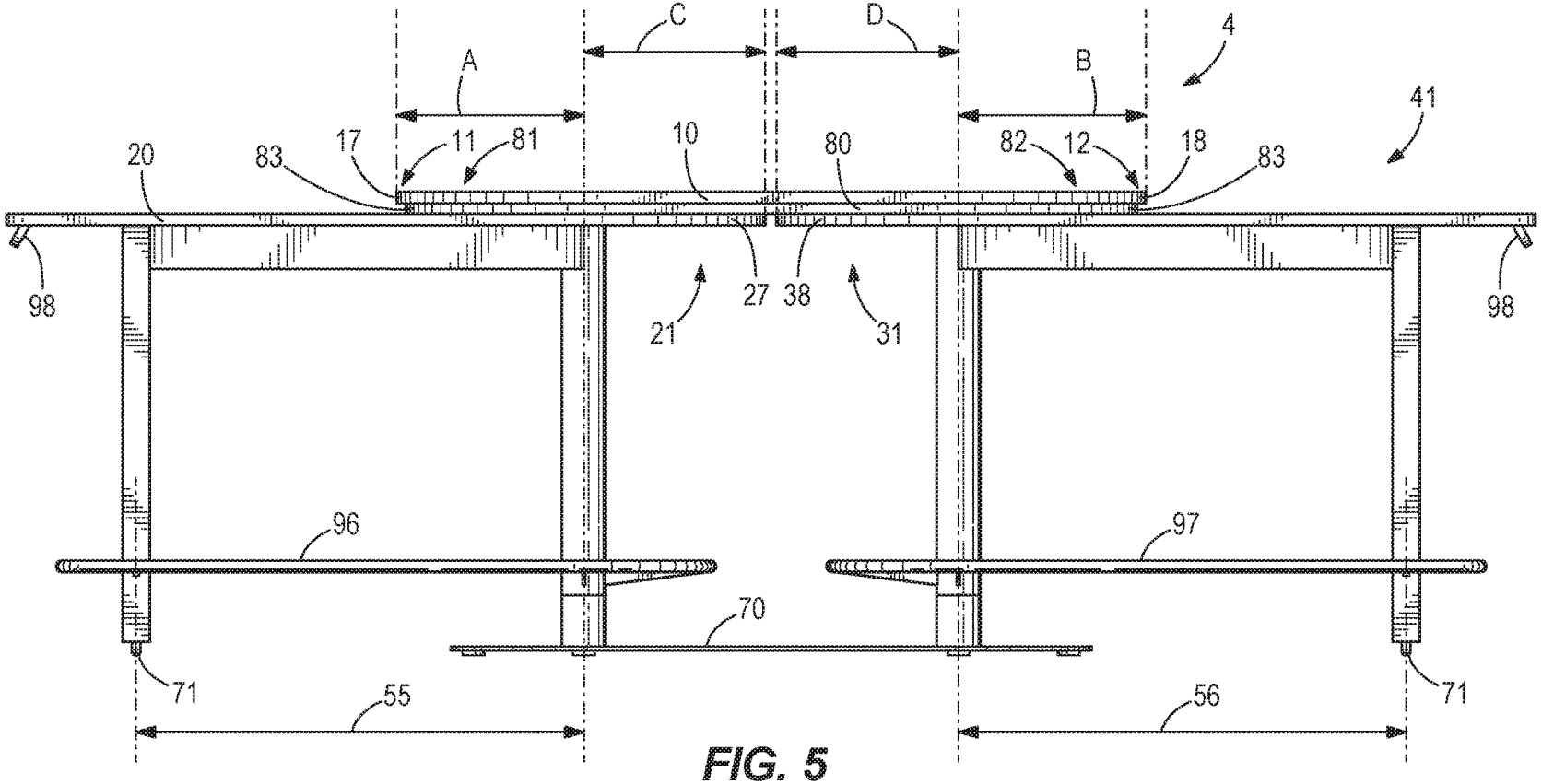
FIG. 5 is a side view of the table apparatus depicted in FIG. 1.
Figure 6:
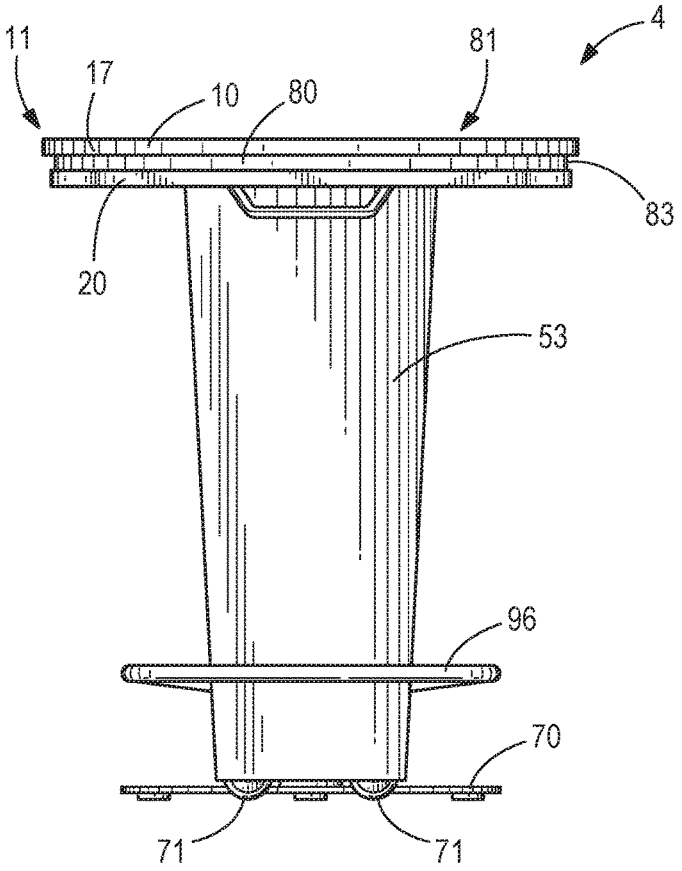
FIG. 6 is an end view of the table apparatus depicted in FIG. 1.
Figure 7:
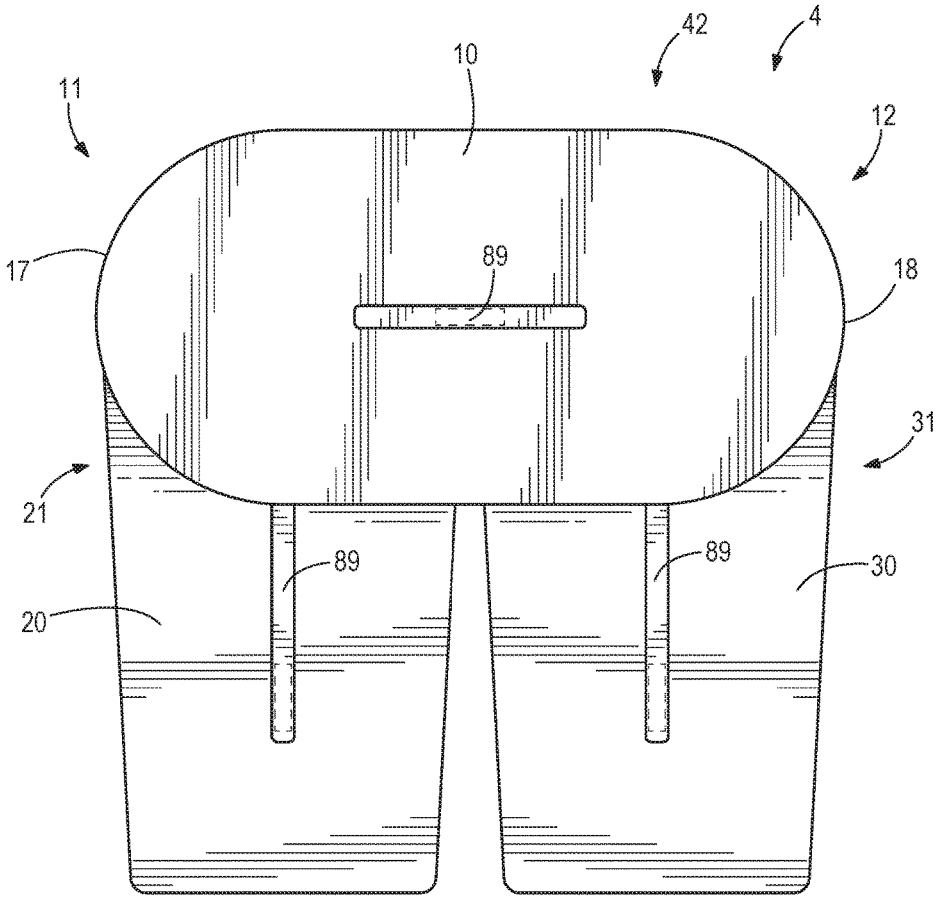
FIG. 7 is the table apparatus depicted in FIG. 1 in an alternate position.
Figure 8:
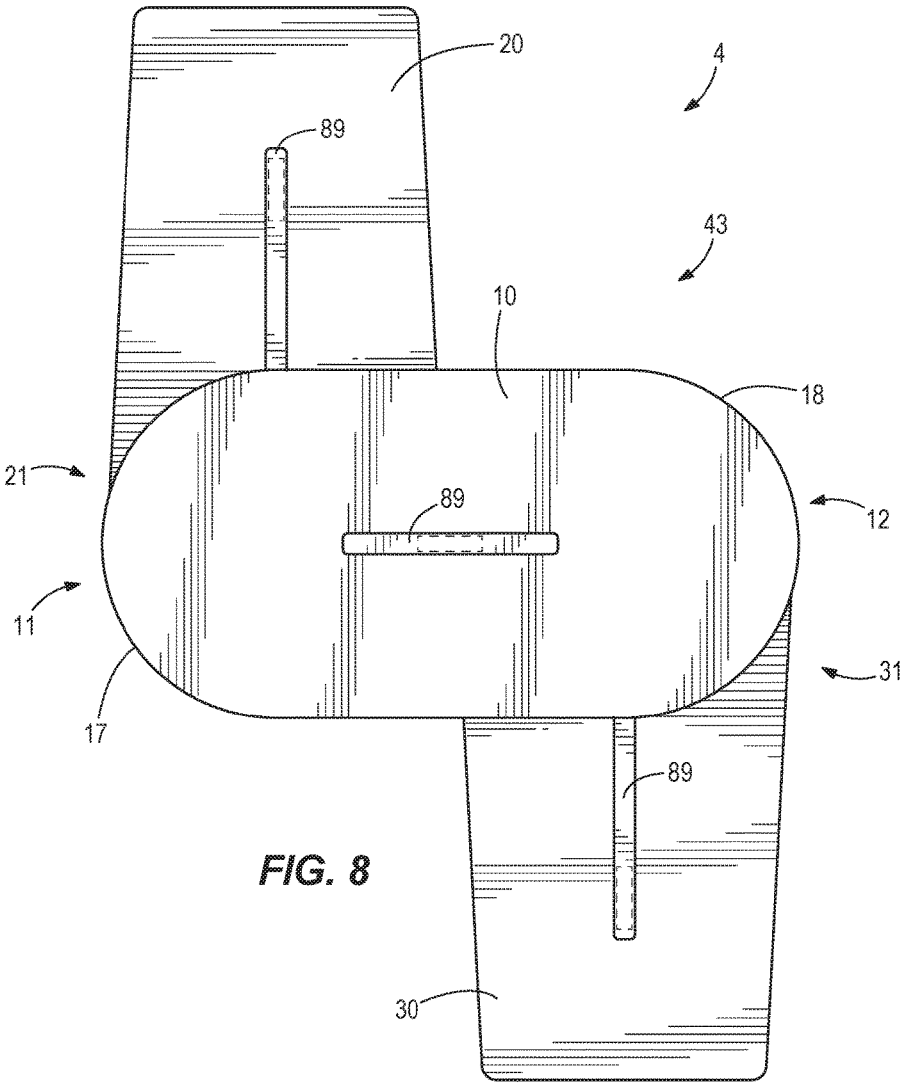
FIG. 8 is the table apparatus depicted in FIG. 1 in an alternate position.

FIGS. 1-8 depict one example of a table apparatus 4 according to the present disclosure. The table apparatus 4 includes a first work surface 10 having a first end 11 and a second end 12 that is opposite the first end 11. A first pivot axis 15 is located radially inwardly from the first end 11 of the first work surface 10 at a first inset distance A. A second pivot axis 16 is located radially inwardly from the second end 12 of the first work surface 10 at a second inset distance B (FIGS. 1, 2, and 5). The second pivot axis 16 is parallel to and spaced apart from the first pivot axis 15. In the illustrated example, the first inset distance A is equal to the second inset distance B. The first work surface 10 includes an outer perimeter 17 at the first end 11 and an outer perimeter 18 at the second end 12. In the illustrated example, the outer perimeters 17, 18 have radius edges.

The table apparatus 4 includes a second work surface 20 and a third work surface 30. The second work surface 20 has a first end 21 and an outer perimeter 27 at the first end 21. The second work surface 20 is located with respect to the first work surface 10 such that the first pivot axis 15 is spaced inward from the first end 21 of the second work surface 20 at a third inset instance C (FIGS. 2 and 5). The second work surface 20 is pivotable with respect to the first work surface 10 at the first pivot axis 15 such that when the second work surface 20 pivots about the first pivot axis 15, the outer perimeter 27 remains radially inward of the outer perimeter 17 (FIG. 2; see also FIGS. 3, 7, and 8). The third inset distance C is equal to the first inset distance A. In the illustrated example, the outer perimeter 27 has a radius edge The third work surface 30 has a first end 31 and an outer perimeter 38 at the first end 31 of the third work surface 30. The third work surface 30 is located with respect to the first work surface 10 such that second pivot axis 16 is spaced inward from the first end 31 of the third work surface 30 at a fourth inset distance D (FIGS. 2 and 5). The third work surface 30 is pivotable with respect to the first work surface 10 at the second pivot axis 16 such that when the third work surface 30 pivots about the second pivot axis 16 the outer perimeter 38 remains inward of the outer perimeter 18 (FIG. 2; see also FIGS. 3, 7, and 8). The fourth inset distance D is equal to the second inset distance B. In the illustrated example, the outer perimeter 38 has a radius edge. In one example, the first, second, third, and outer perimeters 17, 18, 27, 38 have radius edges with equivalent radii.

The table apparatus 4 can include any number of work surfaces 10, 20, 30, and the work surfaces 10, 20, 30 can be planar or non-planer. The work surfaces 10, 20, 30 are pivotable into a variety of positions such that the table apparatus 4 forms different shapes. The table apparatus 4 forms an "I"-shape in an exemplary first position 41 (see FIGS. 1-6), a quadrilateral shape in an exemplary second position 42 (see FIG. 7), and an "S"-shape in an exemplary third position 43 (see FIG. 8). The second and third work surfaces 20, 30 can pivot to first position 31, the second position 32, the third position 33, and/or other positions there between. In the illustrated example, the first work surface 10 is located vertically (axially) above the second and third work surfaces 20, 30, and the second and third work surfaces 20, 30 are positioned at the same vertical (axial) distance from the first work surface 10.

The table apparatus 4 includes a first support 51 positioned at the first pivot axis 15, and a second support 52 positioned at the second pivot axis 16 (FIG. 5). Together the first support 51 and the second support 52 axially support the first work surface 10, second work surface 20, and the third work surface 30. The table apparatus 4 includes a third support 53 that is coupled to and supports the second work surface 20 and a fourth support 54 that is coupled to and supports the third work surface 30 (FIG. 5). The third support 53 is positioned radially form the first pivot axis 15 at a first radial distance 55 (FIGS. 1, 2, and 5). Similarly, the fourth support 54 is positioned radially from the second pivot axis 16 at a second radial distance 56. In one example, the second radial distance 56 is equivalent to the first radial distance 57. The supports 51, 52, 53, 54 can be any shape and be made of any suitable material such as wood, plastic, metal, and/or the like. For example, the first and second supports 51, 52 can be cylindrically-shaped and made of metal. The table apparatus 4 can include additional support members that further support the work surfaces 10, 20, 30. The supports 51, 52, 53, 54 can include brackets, base plates 70, and/or wheels 71. The base plate 70 contacts a horizontal surface (not shown) and prevents the table apparatus 4 from tipping over. The base plate 70 can be coupled to more than one support 51, 52, 53, 54. The wheels 71 can be casters, rollers, slides, and/or the like and include locking mechanisms to prevent the table apparatus 4 from moving from a desired position.

Figure 9:
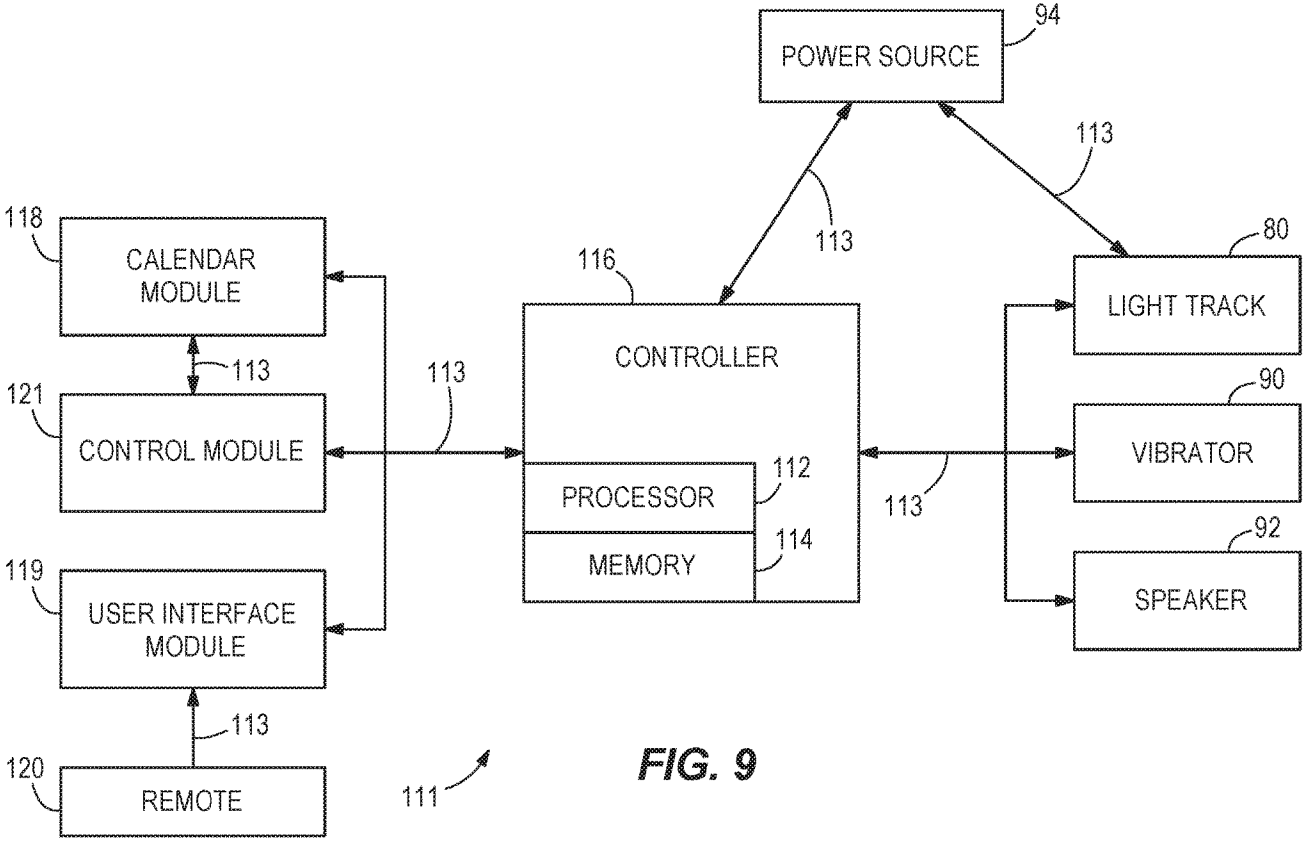
FIG. 9 is an example system diagram.

Referring to FIG. 9, the table apparatus 4 can be part of and controlled by an indicator system. The indicator system 111 includes a controller 116 that is programmable and includes a processor 112 and a memory 114. The controller 116 can be located anywhere in the indicator system and/or located remote from the indicator system and can communicate with various components of the table apparatus 4 via wired and/or wireless links, as will be explained further herein below.

Although FIG. 9 shows a controller 116, the indicator system can include more than one controller. Each controller can have one or more control sections or control units. One having ordinary skill in the art will recognize that the controller 116 can have many different forms and is not limited to the example that is shown and described. In some examples, the controller 116 may include a computing system that includes a processing system, storage system, software, and input/output (I/O) interfaces for communicating with devices such as those shown in FIG. 9, and about to be described herein. The processing system loads and executes software from the storage system, such as software programmed with a notification control method. When executed by the computing system, notification control software directs the processing system to operate as described herein below in further detail to execute notifications such as light illumination, light colors, audible sounds, and/or vibrations. The computing system may include one or many application modules and one or more processors, which may be communicatively connected. The processing system can comprise a microprocessor (e.g., processor 112) and other circuitry that retrieves and executes software from the storage system. Processing system can be implemented within a single processing device but can also be distributed across multiple processing devices or sub-systems that cooperate in existing program instructions. Non-limiting examples of the processing system include general purpose central processing units, applications specific processors, and logic devices.

The storage system (e.g., memory 114) can comprise any storage media readable by the processing system and capable of storing software. The storage system can include volatile and non-volatile, removable and non-removable media implemented in any method or technology for storage of information, such as computer readable instructions, data structures, program modules, or other data. The storage system can be implemented as a single storage device or across multiple storage devices or sub-systems. The storage system can further include additional elements, such as a controller capable of communicating with the processing system. Non-limiting examples of storage media include random access memory, read only memory, magnetic discs, optical discs, flash memory, virtual memory, and non-virtual memory, magnetic sets, magnetic tape, magnetic disc storage or other magnetic storage devices, or any other medium which can be used to store the desired information and that may be accessed by an instruction execution system. The storage media can be a non-transitory or a transitory storage media.

In the illustrated example, the controller 116 is configured to communicate with one or more components of the indicator system via a communication link 113, which can be a wired or wireless link. The controller 116 is capable of monitoring and controlling one or more operational characteristics of the indicator system and its various subsystems by sending and receiving control signals via the communication link 113. It should be noted that the extent of connections of the communication link 113 shown herein is for schematic purposes only, and the communication link 113 in fact provides communication between the controller 116 and each of the sensors, devices, and various subsystems described herein, although not every connection is shown in the drawing for purposes of clarity.

The indicator system 111 may include several modules. For example, a calendar module 118 can be connected to a network and provide meeting information. The start time and end time for a meeting can be relayed by the calendar module 118 to the controller 116. The controller 116 can be configured to relay data to the notification devices, such as a lighting device in the form of a light track 80, a vibrator 91, and/or a speaker 92. In one example, the light track 80 may illuminate a green color at the start time of the meeting, illuminate a yellow color ten minutes before the end time of the meeting, and/or illuminate a red color at the end time of the meeting.

The indicator system 111 can include a user interface module 119 that is configured to allow the user to control the light track 80, the vibrator 91, and/or the speaker 92. For example, indicator system can be configured to allow the user to increase the light from the light track 80 or play music through the speaker 92. The user interface module 119 may be connected to a remote 120, a control panel, a connection port, and/or the like. A control module 121 such as an internet or network module may connect the table apparatus 4 to the internet. The control module 121 may also provide calendar data to the calendar module 118. The control module 121 may be wireless or wired, and the control module 121 may allow a remote user to control the components of the table apparatus 4 or participate in the meeting.

The light track 80 is axially positioned between the first work surface 10, the second work surface 20, and/or the third work surface 30 (FIGS. 1, 2, and 5). The light track 80 is configured to illuminate the second work surface 20 and/or the third work surface 30. The light track 80 has a pair of opposite ends 81, 82 and an outer perimeter 83. The outer perimeter 83 is located inward from the outer perimeters 17, 18 of the first work surface 10 when the light track 80 is adjacent to the first work surface 10. The light track 80 is coupled to the first work surface 10 such that the light track 80 remains stationary as the second work surface 20 and/or third work surface 30 pivot, as described herein above. The light track 80 can be coupled to the second work surface 20 and/or third work surface 30 such that the light track 80 pivots as the second work surface 20 and/or third work surface 30 rotates. The light track 80 can include LED lights, fiber optics, and/or other electronic lighting devices. The light track 80 can be powered by a power source 94 such as a battery pack, wall-outlet, ambient light harvester, and/or the like. In certain examples, the light track 45 illuminates the table apparatus 4 with different colors.

The table apparatus 4 includes a channel 89 recessed into at least one work surface 10, 20, 30. The channel 89 is configured to contain and conceal power cords, office supplies, network cables, and/or other objects. In some examples, the channel 89 extends outwardly axially from the at least one work surface 10, 20, 30.

The table apparatus 4 includes a first footrest 96 coupled to the first and third supports 51, 53 and a second footrest 97 coupled to the second and fourth supports 52, 54. The footrests 96, 97 pivot with the second and third work surface 20, 30 as the second and third work surfaces 20, 30 pivot, as described herein above. The footrests 96, 97 can be coupled to any support 51, 52, 53, 54, alone or in combination.

The table apparatus includes a handles 98 coupled to the second and third work surfaces 20,30 such that the user can grasp the handles 98 and pivot the second and/or third work surface 20, 30 as described above.

It will thus be seen that the present disclosure provides table apparatuses that have a first work surface having a first end and a second end that is opposite the first end; a second work surface that is pivotable with respect to the first work surface at a first pivot axis; and a third work surface that is pivotable with respect to the first work surface at a second pivot axis that is parallel to and spaced apart from the first pivot axis. The first work surface and second work surface are overlapping and the first work surface and the third work surface are overlapping. The first pivot axis is located radially inwardly from the first end of the first work surface at a first inset distance and wherein the second pivot axis is located radially inwardly from the second end of the first work surface at a second inset distance that is equal to the first inset distance.

In certain examples, the second work surface has a first end and a second end that is opposite the first end; the third work surface has a first end and a second end that is opposite the first end; the first pivot axis is located inward from the first end of the second work surface at a third inset distance; and the second pivot axis is located inward from the first end of the third work surface at a fourth inset distance that is equal to the third inset distance. The third inset distance and the fourth inset distance are equal to the first inset distance.

In certain examples, the first end of the second work surface an outer perimeter; the first end of the third work surface has an outer perimeter; as the second work surface is pivoted about the first pivot axis, the outer perimeter of the first end of the second work surface remains overlapped with the first end of the first work surface; and as the third work surface is pivoted about the second pivot axis, the outer perimeter of the first end of the third work surface remains overlapped with the second end of the first work surface. The outer perimeter of the first end of the second work surface and the outer perimeter of the first end of the third work surface have equivalent curvature.

In certain examples, the first work surface is located vertically or axially above the second work surface and the third work surface with respect to the first and second pivot axes, respectively. The second and third work surfaces are positioned at an equal vertical (axial) distance from the first work surface with respect to the first and second pivot axes, respectively.

The second and third work surfaces are pivotable into a position wherein the table apparatus forms a quadrilateral when viewed along the first and second pivot axes and also into a position wherein the table apparatus forms an "S"-shape when viewed along the first and second pivot axes.

In certain examples, a first vertical support is positioned at the first pivot axis, the first vertical support configured to support the first work surface and the second work surface. A second vertical support positioned at the second pivot axis, the second vertical support configured to support the first work surface and the third work surface. A third vertical support is connected to and supporting the second work surface and a fourth vertical support connected to and supporting the third work surface; wherein the third vertical support is radially spaced apart from the first pivot axis at a first radial distance and wherein the fourth vertical support is radially spaced apart from the second pivot axis at a second radial distance. The first radial distance is equivalent to the second radial distance. A first footrest is connected to the first vertical support and the third vertical support and a second footrest connected to the second vertical support and the fourth vertical support.

In certain examples, a lighting device is positioned between the first work surface and the second work surface, wherein the lighting device is configured to illuminate the second work surface. A controller is configured to control illumination of the lighting device. The lighting device follows the outer perimeters of the first and second ends of the first work surface and is located radially inwardly from the outer perimeters of the first and second ends of the first work surface.

In the present description, certain terms have been used for brevity, clearness and understanding. No unnecessary imitations are to be implied therefrom beyond the requirement of the prior art because such terms are used for descriptive purposes only and are intended to be broadly construed. The different apparatuses and systems described herein may be used alone or in combination with other apparatuses and systems. Various equivalents, alternatives and modifications are possible within the scope of the appended claims.

What is claimed is:

1. A table apparatus comprising:

a first work surface having a first end, a second end that is opposite the first end, and an outer perimeter;

a second work surface that is pivotable with respect to the first work surface at a first pivot axis wherein the second work surface is vertically below the first work surface;

a third work surface that is pivotable with respect to the first work surface at a second pivot axis that is parallel to and spaced apart from the first pivot axis, wherein the third work surface is vertically below the first work surface and coplanar with the second work surface;

wherein the first work surface and second work surface are overlapping, wherein the first work surface and the third work surface are overlapping, and wherein a gap is defined vertically directly below the first work surface and vertically directly above the second work surface and the third work surface; and a lighting device disposed in the gap and configured to illuminate the second work surface and the third work surface, wherein the lighting device is further configured to remain stationary as the second work surface or the third work surface pivot, and wherein the lighting device has an outer perimeter that is radially inward of the outer perimeter of the first work surface.

2. The table apparatus according to claim 1, wherein the first pivot axis is located radially inwardly from the first end of the first work surface at a first inset distance and wherein the second pivot axis is located radially inwardly from the second end of the first work surface at a second inset distance that is equal to the first inset distance.

3. The table apparatus according to claim 2, wherein the second work surface has a first end and a second end that is opposite the first end;

the third work surface has a first end and a second end that is opposite the first end;

the first pivot axis is located inward from the first end of the second work surface at a third inset distance; and the second pivot axis is located inward from the first end of the third work surface at a fourth inset distance that is equal to the third inset distance.

4. The table apparatus according to claim 3, wherein the third inset distance and the fourth inset distance are both equal to the first inset distance.

5. The table apparatus according to claim 3, wherein the second work surface has an outer perimeter;

the third work surface has an outer perimeter; and wherein as the second work surface is pivoted about the first pivot axis, the outer perimeter of the second work surface remains overlapped with the first work surface; and wherein as the third work surface is pivoted about the second pivot axis, the outer perimeter of the third work surface remains overlapped with the first work surface.

6. The table apparatus according to claim 1, further comprising a first vertical support extending along the first pivot axis and configured to support the first work surface and the second work surface, a second vertical support extending along the second pivot axis and configured to support the first work surface and the third work surface, and a base plate coupled to the first vertical support and the second vertical support and configured to prevent tipping of the work surfaces.

7. The table apparatus according to claim 6, further comprising a third vertical support with a wheel coupled to and supporting the second work surface and a fourth vertical support with a wheel coupled to and supporting the third work surface; wherein the third vertical support is radially spaced apart from the first pivot axis at a first radial distance such that as the second work surface pivots about the first pivot axis, the wheel of the third vertical support permits the third vertical support to move along a first radial path relative to the first pivot axis and wherein the fourth vertical support is radially spaced apart from the second pivot axis at a second radial distance such that as the third work surface pivots about the second pivot axis, the wheel of the fourth vertical support permits the fourth vertical support to move along a second radial path relative to the second pivot axis, and wherein the first vertical support, the second vertical support, and the base remain stationary as the second work surface and the third work surface pivot.

8. The table apparatus according to claim 6, further comprising a first footrest that encircles to the first vertical support and the third vertical support and a second footrest that encircles to the second vertical support and the fourth vertical support.

9. The table apparatus according to claim 1, further comprising a controller configured to control illumination of the lighting device.

10. A table apparatus comprising:

a first work surface having a first end, a second end that is opposite the first end, and an outer perimeter;

a second work surface that is pivotable with respect to the first work surface at a first pivot axis, wherein the second work surface is vertically below the first work surface and wherein the second work surface has an outer perimeter that remains overlapped with the first work surface as the second work surface is pivoted; and a third work surface that is pivotable with respect to the first work surface at a second pivot axis that is parallel to and spaced apart from the first pivot axis, the third work surface is vertically below the first work surface and coplanar with the second work surface, and the third work surface has an outer perimeter that remains overlapped with the first work surface as the third work surface is pivoted;

a gap defined vertically directly below the first work surface and vertically directly above the second work surface and the third work surface;

a lighting device disposed in the gap and configured to illuminate the second work surface and the third work surface, wherein the lighting device is further configured to remain stationary as the second work surface or the third work surface pivot, and wherein the lighting device has an outer perimeter that is radially inward of the outer perimeter of the first work surface;

a first vertical support extending along the first pivot axis and configured to support the first work surface and the second work surface;

a second vertical support extending along the second pivot axis and configured to support the first work surface and the third work surface;

a third vertical support with a wheel coupled to and supporting the second work surface, the third vertical support is radially spaced apart from the first pivot axis at a first radial distance such that as the second work surface pivots about the first pivot axis the wheel of the third vertical support permits the third vertical support to move along a first radial path relative to the first pivot axis;

a fourth vertical support with a wheel coupled to and supporting the third work surface, the fourth vertical support is radially spaced apart from the second pivot axis at a second radial distance such that as the third work surface pivots about the second pivot axis the wheel of the fourth vertical support permits the fourth vertical support to move along a second radial path relative to the second pivot axis;

a base plate coupled to the first vertical support and the second vertical support and configured to prevent tipping of the work surfaces, wherein the base plate, the first vertical support, and the second vertical support remain stationary as the second work surface and the third work surface pivot;

a first footrest that encircles to the first vertical support and the third vertical support; and a second footrest that encircles to the second vertical support and the fourth vertical support.

11. An indicator system comprising:

a first work surface having a first pivot axis and a second pivot axis that is parallel to and spaced apart from the first pivot axis;

a second work surface pivotable with respect to the first work surface at the first pivot axis, wherein the second work surface is vertically below the first work surface; and a third work surface pivotable with respect to the first work surface at the second pivot axis, wherein the third work surface is vertically below the first work surface and coplanar with the second work surface;

a gap defined vertically directly below the first work surface and vertically directly above the second work surface and the third work surface;

a controller connected to a network and having calendar module that is configured to receive meeting data from the network; and a lighting device disposed in the gap and in communication with the controller, the lighting device being configured to illuminate the second work surface and the third work surface based on the meeting data received by the calendar module.

12. The indicator system according to claim 11, wherein the meeting data received from the network includes meeting start time and meeting end time, and wherein the lighting device is configured to illuminate the second work surface and the third work surface with green light at the meeting start time and illuminate the second work surface and the third work surface with red light at the meeting end time.

13. The indicator system according to claim 12, wherein the lighting device is configured to illuminate the second work surface and the third work surface with yellow light prior to the meeting end time.

14. The indicator system according to claim 13, further comprising a user control panel in communication with the controller and configured to receive an input from a user, and wherein the controller is configured to control the lighting device based on the input from the user.

15. The indicator system according to claim 14, further comprising a speaker disposed in the gap and in communication with the controller, wherein the controller controls the speaker to thereby produce audible sounds based on the meeting data received.

16. The indicator systems according to claim 15, wherein the controller is configured to control the speaker based on the input from the user.

* * * * *